US011679917B2

(12) United States Patent
Huang

(10) Patent No.: US 11,679,917 B2
(45) Date of Patent: Jun. 20, 2023

(54) LOCKING STRUCTURE OF CUP

(71) Applicant: Shenzhen Alltokee Technology Co., Ltd, Shenzhen (CN)

(72) Inventor: Minyi Huang, Lianping (CN)

( * ) Notice: Subject to any disclaimer, the term of this patent is extended or adjusted under 35 U.S.C. 154(b) by 0 days.

(21) Appl. No.: 17/454,828

(22) Filed: Nov. 15, 2021

(65) Prior Publication Data

US 2022/0073244 A1 Mar. 10, 2022

(30) Foreign Application Priority Data

May 31, 2021 (CN) ..... 202110602564.2

(51) Int. Cl.
*B65D 55/12* (2006.01)
*B65D 51/24* (2006.01)

(52) U.S. Cl.
CPC ..... *B65D 55/12* (2013.01); *B65D 51/243* (2013.01)

(58) Field of Classification Search
CPC .... B65D 1/265; B65D 81/3865; B65D 55/12; B65D 51/243; B65D 41/62; B65D 50/046; B65D 55/02; B65D 55/06; B65D 55/10; B65D 55/14; B65D 63/08; A47J 27/08
See application file for complete search history.

(56) References Cited

U.S. PATENT DOCUMENTS 735,642 A * 8/1903 Wilson ..... B65D 41/62 215/251
775,651 A * 11/1904 Heath ..... B65D 51/243 215/305
829,341 A * 8/1906 Kirkegaard ..... B65D 51/243 215/305
4,616,763 A * 10/1986 Ruhl ..... B65D 55/02 220/270
10,239,673 B1 * 3/2019 Dejonge ..... B65D 50/04
2010/0170898 A1 * 7/2010 Skelton ..... B65D 55/022 220/214
2011/0062170 A1 3/2011 Kemper et al.
2017/0313479 A1 11/2017 Li et al.
2019/0075950 A1 3/2019 Xu

* cited by examiner

*Primary Examiner* — Kareen K Thomas
(74) *Attorney, Agent, or Firm* — Richard Gerald Topolewski

(57) ABSTRACT

The invention discloses a locking structure of a cup. The locking structure comprises a cup body and a cup cover. The cup body is provided with a first buckle, and the cup cover is provided with a second buckle adaptive to the first buckle. The locking structure further comprises a lock catch which is movably arranged on the cup cover up and down. The lock catch is provided with a bolt. Correspondingly, the cup body is provided with a bolt hole adaptive to the bolt. The cup cover rotates on the cup body, so that the first buckle and the second buckle are matched. When aligned, the bolt falls into the bolt hole, thereby realizing rotary locking.

9 Claims, 8 Drawing Sheets

LOCKING STRUCTURE OF CUP

BACKGROUND OF THE INVENTION

1. Technical Field

The invention relates to the field of cups, in particular to a locking structure of a cup.

2. Description of Related Art

Conventional cup covers and cup bodies realize covering (locking) by way of threaded connections or buckle connections, and the opening modes are simpler (they are rotated reversely or pressed and buckled directly). Along with social progress, people pay more attention to privacy and safety, a way of opening the cup cover by way of opening the cup cover by fingerprinting unlocking emerges later. However, the fingerprint unlocking mode still has defects that the manufacturing cost is high, the invisibility is poor and the opening way is easily known.

Thus, it is necessary to design a novel technical scheme to solve the problem.

BRIEF SUMMARY OF THE INVENTION

In order to solve the defects and deficiencies in the prior art, the invention provides a locking structure of a cup. A specific locking design of the cup body and the cup cover solves the problem that conventional pressing type and fingerprint unlocking type structures are easily unlocked by others or the unlocking modes are known to the others as the structures are insufficient in invisibility, so that the privacy, the property safety and the life safety of a user are further guaranteed.

A technical scheme adopted by the invention is that of a locking structure of a cup, as a preferred scheme, includes a cup body and a cup cover, herein the cup body is provided with a first buckle, and the cup cover is provided with a second buckle adaptive to the first buckle; the locking structure further comprises a lock catch which is movably arranged on the cup cover up and down; wherein the lock catch is provided with a bolt, and correspondingly, the cup body is provided with a bolt hole adaptive to the bolt;

the cup cover rotates on the cup body, so that the first buckle and the second buckle are matched. When aligned, the bolt falls into the bolt hole, thereby realizing rotary locking.

As a preferred scheme, the locking structure of a cup further includes an unlocking piece, herein the unlocking piece and the lock catch are arranged in a mutual adsorbing manner; and when the unlocking piece is placed on an upper side of the lock catch, the unlocking piece sucks the lock catch upwards, so that the bolt is separated from the bolt hole, thereby realizing rotary unlocking.

As a preferred scheme, the unlocking piece and the lock catch are magnets with opposite magnetisms;

or one of the unlocking piece and the lock catch is a magnet while the other is a magnetic metal piece.

As a preferred scheme, the upper side of the lock catch is provided with an elastic piece, so that the lock catch has an action force of moving downwards.

As a preferred scheme, the first buckle is an "L"-shaped slot provided with a vertical clamp-in portion and a clamping portion connected to a lower end of the clamp-in portion; the clamp-in portion is provided with an upward through opening; and the second buckle is a clamping protrusion, and when the second buckle is locked, the clamping protrusion enters the lower end of the clamp-in portion from the opening of the clamp-in portion, and the clamping protrusion enters and is limited by the clamping portion of the slot as the cup cover rotates.

As a preferred scheme, the lock catch includes a lock catch base, the bolt is formed by extending along an outer edge of the lock catch base, and several bolts are formed at an interval in the outer edge of the lock catch base, and correspondingly, the cup body is further provided with corresponding several bolt holes.

As a preferred scheme, the cup cover includes a rotating cover and an outer shell, the outer shell covering an outer side of the rotating cover and being formed with a mounting cavity for mounting the lock catch and the lock catch being movably arranged on the mounting cavity up and down.

As a preferred scheme, a lower side surface of the cup body is upwards provided with a placing position for storing the unlocking piece in a concave manner.

The invention has the beneficial effects that compared with the prior art, a specific locking design of the cup body and the cup cover solves the problem that conventional pressing type and fingerprint unlocking type structures are easily unlocked by others or the unlocking modes are known to the others as the structures are insufficient in invisibility, so that the privacy, the property safety and the life safety of a user are further guaranteed; further, the locking structure of the invention is skillful in locking design, firm and reliable to lock, simple in opening mode, low in manufacturing cost and higher in practicality, and has a considerable market prospect.

NUMERALS OF DRAWINGS

100, cup body, 101, slot,
1011, clamp-in portion, 1012, clamping portion,
10, lock catch, 11, bolt,
12, bolt hole, 13, lock catch base,
20, elastic piece, 30, spring fixing rack,
200, cup cover, 201, clamping protrusion,
202, unlocking concave position, 210, rotating cover,
220, outer shell, 300, unlocking piece,
301, magnet protecting shell, 302, magnet.

DETAILED DESCRIPTION OF THE INVENTION

Clear and intact description will be made on technical scheme in the embodiment of the invention below in combination with drawings. Apparently, the described embodiments are merely a part of embodiments of the invention.

Figure 1:
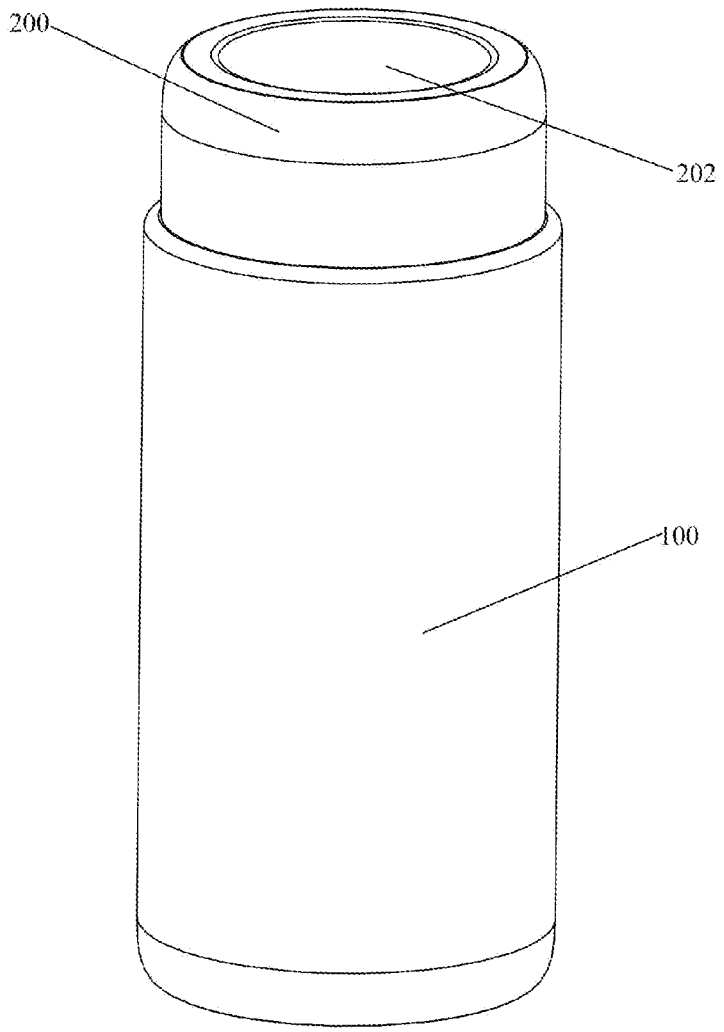
FIG. 1 is a stereogram of an embodiment of the invention.
Figure 2:
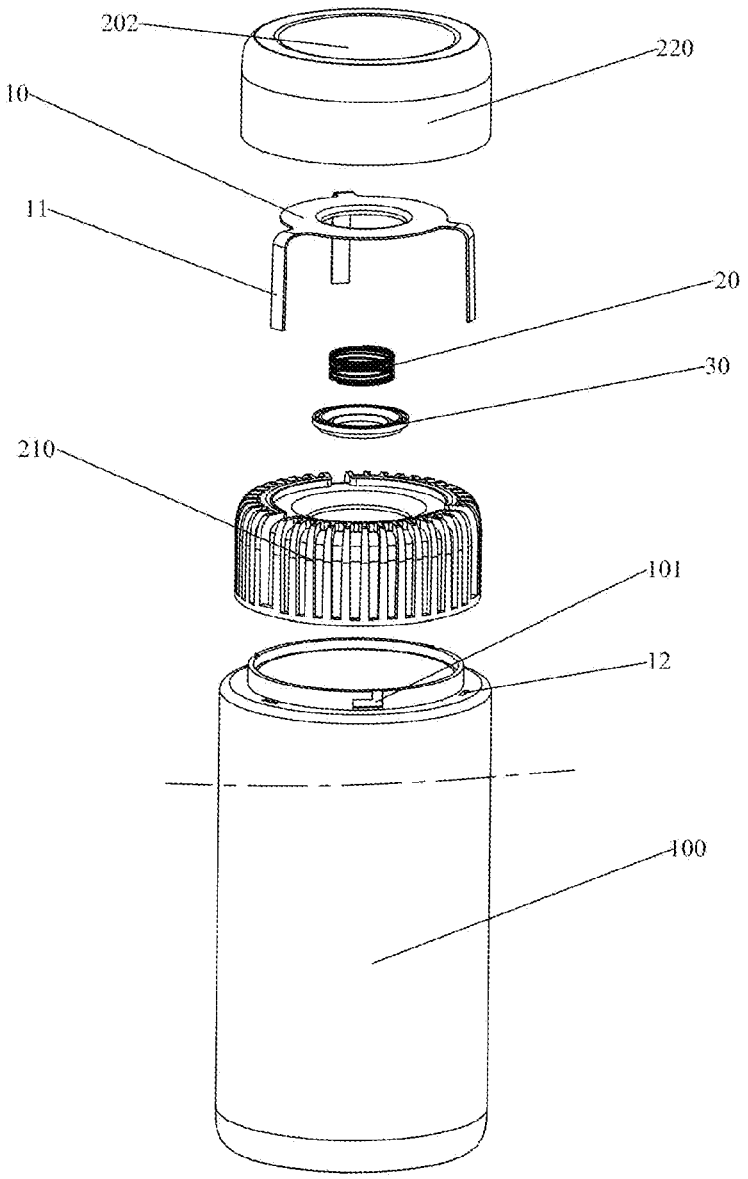
FIG. 2 is an exploded view of an embodiment of the invention.
Figure 3:
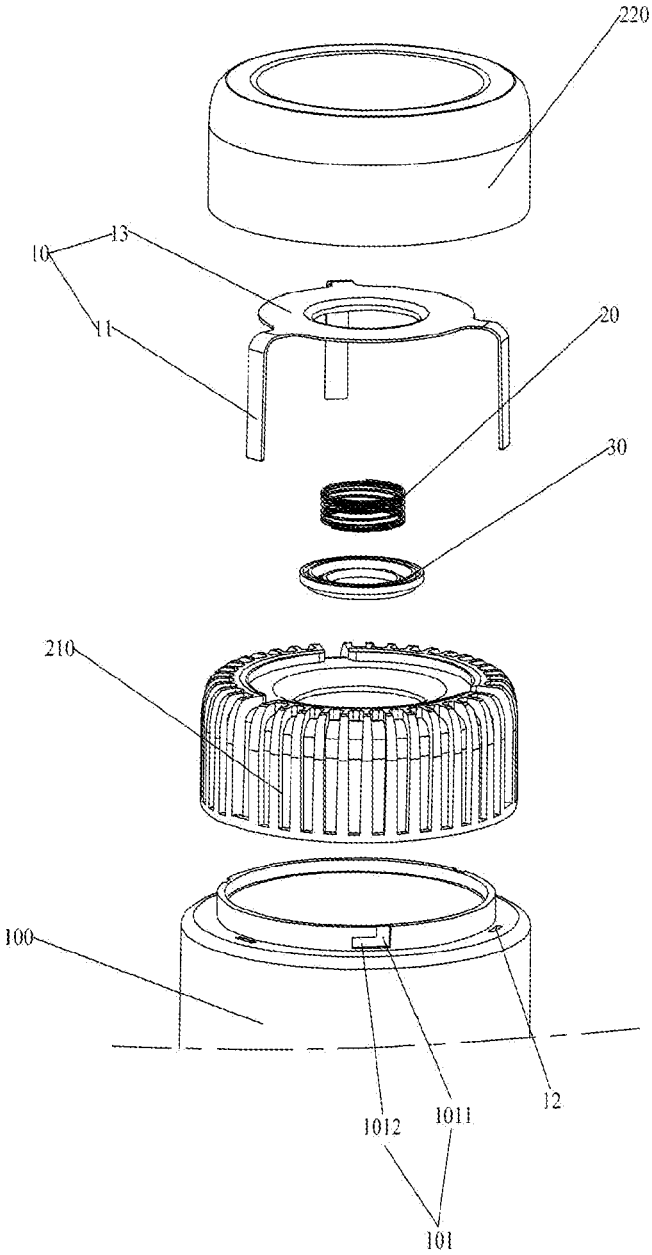
FIG. 3 is a partial enlarged drawing of FIG. 2.
Figure 4:
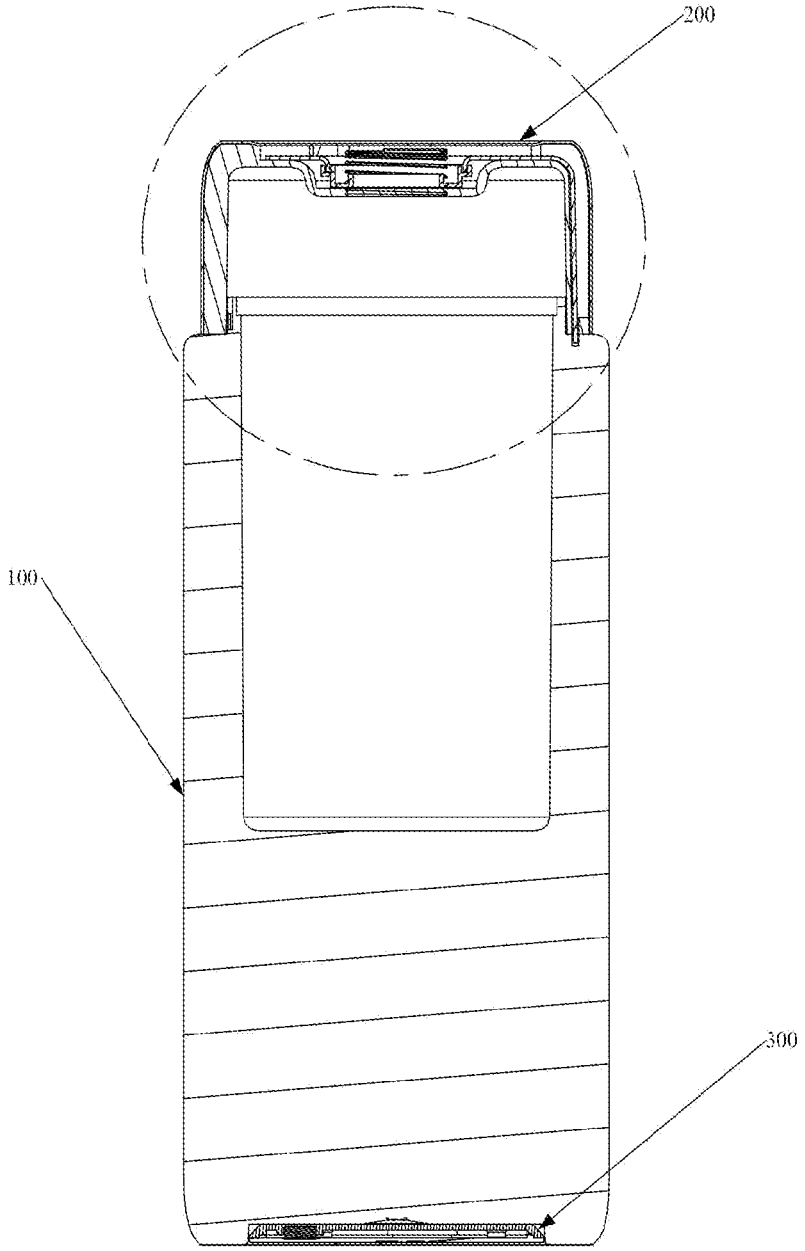
FIG. 4 is a section view of an embodiment of the invention.
Figure 5:
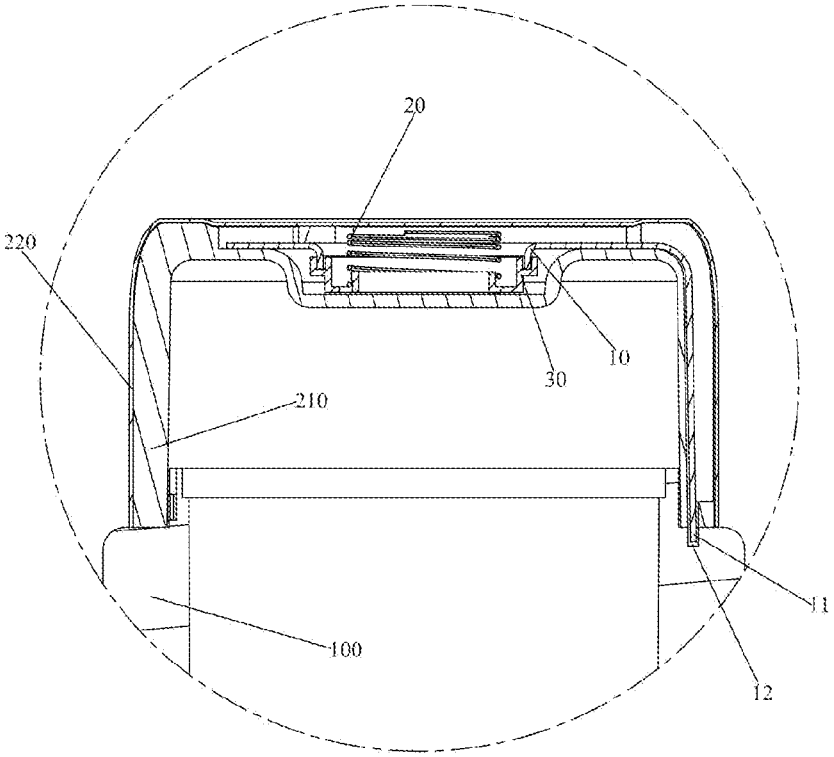
FIG. 5 is a partial enlarged drawing of FIG. 4.
Figure 6:
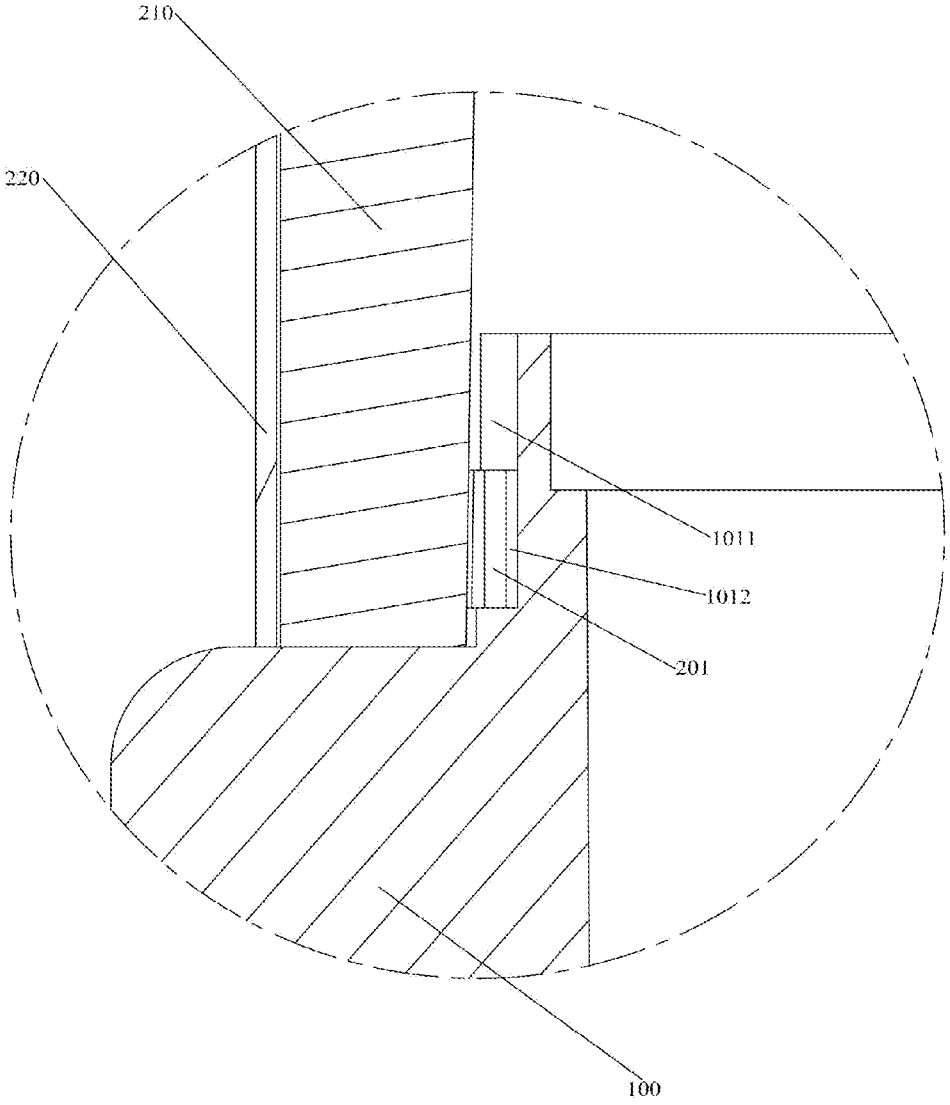
FIG. 6 is a partial section enlarged view of an embodiment of the invention.
Figure 7:
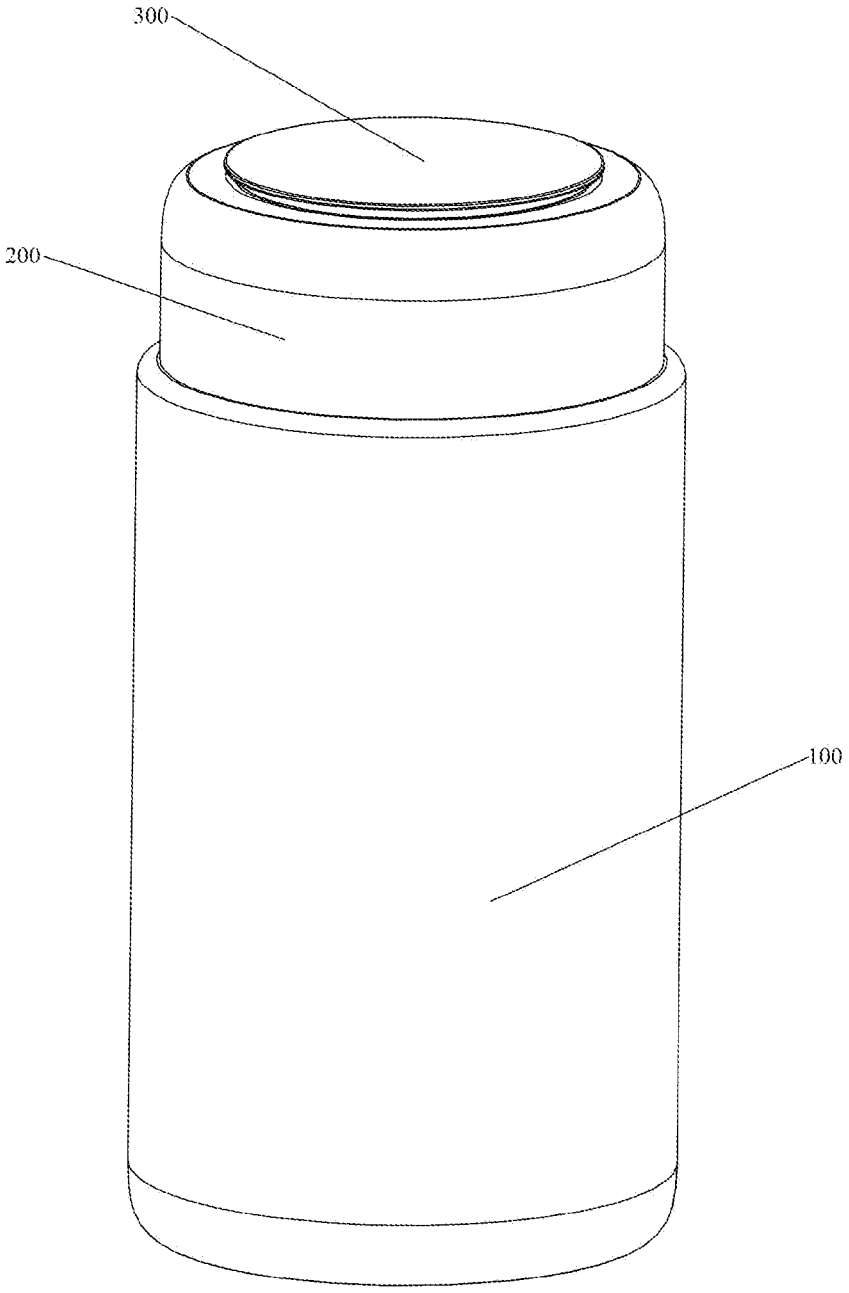
FIG. 7 is another stereogram of an embodiment of the invention (an unlocking piece is placed on a cup cover).
Figure 8:
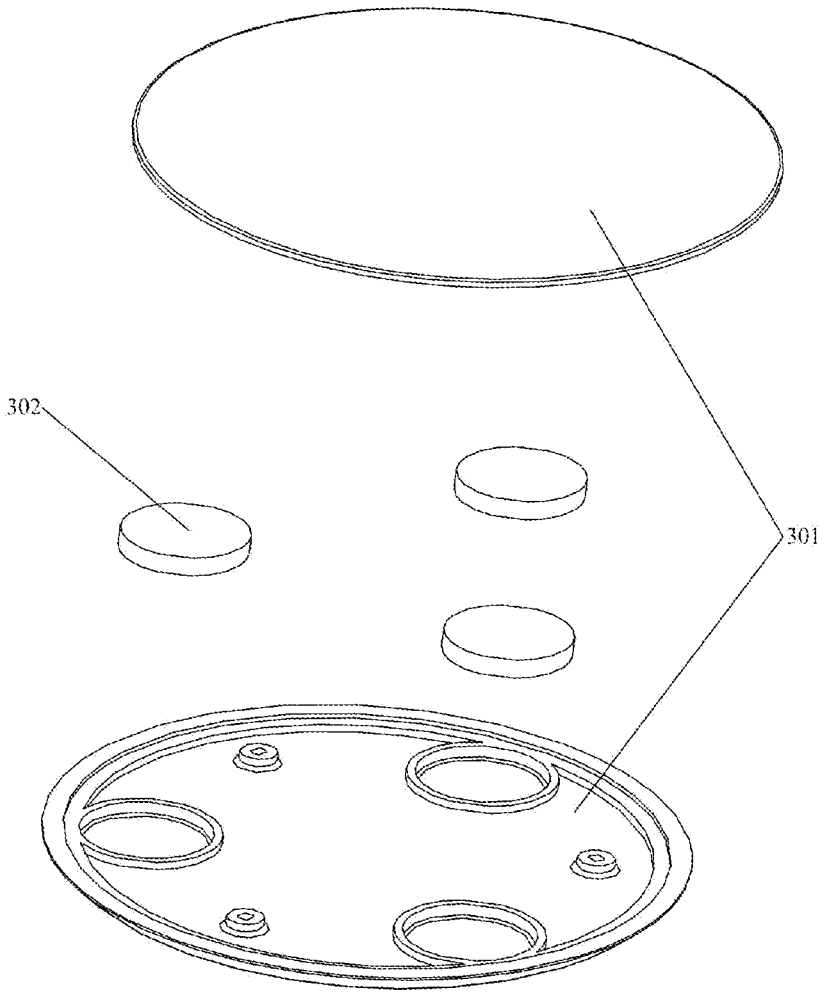
FIG. 8 is an exploded view of an unlocking piece in an embodiment of the invention.

Referring to FIG. 1 to FIG. 8, a locking structure of a cup in the embodiment of the invention includes a cup body 100 and a cup cover 200, herein the cup body 100 is provided with a first buckle, and the cup cover 200 is provided with a second buckle adaptive to the first buckle; the locking structure further includes a lock catch 10 which is movably arranged on the cup cover 200 up and down;

the lock catch 10 is provided with a bolt 11, and correspondingly, the cup body 100 is provided with a bolt hole 12 adaptive to the bolt 11; and The cup cover 200 rotates on the cup body 100 (the cup cover 200 rotates forwards relative to the cup body 100), so that the first buckle and the second buckle are matched. After being aligned, the bolt 11 falls into the bolt hole 12 to lock the cup cover 200 rotatably, so that a user can neither rotate and open the cup cover 200 backwards nor rotate the cup cover forwards, thereby playing an alignment prompt role, too.

In actual use, the locking structure further includes an unlocking piece 300. The unlocking piece 300 and the lock catch 10 are arranged in a mutual adsorbing manner; and when the unlocking piece 300 is placed on an upper side of the lock catch 10, the unlocking piece 300 sucks the lock catch 10 upwards, so that the bolt 11 is separated from the bolt hole 12, thereby realizing rotary unlocking. Therefore, the user can rotate the cup cover 200 backwards and open the cup cover.

Specifically, the unlocking piece 300 and the lock catch 10 can be magnets with opposite magnetisms; or one of the unlocking piece 300 and the lock catch 10 is a magnet while the other is a magnetic metal piece. In the embodiment, the lock catch 10 is a magnetic hardware, the unlocking piece 300 includes a magnet protecting shell 301 and a magnet 302 arranged in the magnet protecting shell 301, and there are several magnets 302 arranged in the magnet protecting shell 301.

Thus, by designing the cup cover 200 and the cup body 100 skillfully, the cup cover 200 and the cup body 100 have the functions of locking and preventing opening by others. Compared with existing fingerprint unlocking, it has an advantage of lower cost. Compared with existing pressing unlocking, it is more attractive and the market prospect is better. In particular, for something important to a consumer, the locking structure design further has certain invisibility, and it is hardly for others to know the unlocking method to prevent the locking structure from being opened by others, so that privacy and benefit of the consumer are better protected. It is to be noted herein that in a specific application, the locking structure of the cup of the invention can be used as a water cup to prevent others from opening the cup cover and prevent others from adding unknown substances into the cup. The locking structure can be further used for storing properties and serves as a storage tank. The cup body can be further provided with some private devices, toys and the like and other cannot find them, so that the privacy of the user (including the cup serving as an outer shell of a product) is protected.

Preferably, the upper side of the lock catch 10 is provided with an elastic piece 20, so that the lock catch 10 has an action force of moving downwards. Generally, the elastic piece 20 is a spring. Certainly, the elastic piece can be an elastic apparatus such as a rubber piece. Therefore, in processes of erecting, inverting and inclining the whole cup, the bolt 11 of the lock catch 10 can be well positioned in the bolt hole 12, so that the locking reliability is guaranteed.

Preferably, the first buckle is an "L"-shaped slot 101 provided with a vertical clamp-in portion 1011 and a clamping portion 1012 connected to a lower end of the clamp-in portion 1011; the clamp-in portion 1011 is provided with an upward through opening.

The second buckle is a clamping protrusion 201, and when the second buckle is locked, the clamping protrusion 201 enters the lower end of the clamp-in portion 1011 from the opening of the clamp-in portion 1011, and the clamping protrusion 201 enters and is limited by the clamping portion 1012 of the slot 101 as the cup cover 200 rotates. Correspondingly, the bolt 11 further correspondingly falls into the bolt hole 12, thereby achieving locking.

Further, the lock catch 10 includes a lock catch base 13, the bolt 11 is formed by extending along an outer edge of the lock catch base 13, and several bolts 11 are formed at an interval in the outer edge of the lock catch base 13, and correspondingly, the cup body 100 is further provided with corresponding several bolt holes 12. Preferably, the elastic piece 20 is further acted to the lock catch base 13. Therefore, on the one hand, the locking stability can be guaranteed and on the other hand, the unlocking effectiveness can be guaranteed.

Generally, the cup cover 200 includes a rotating cover 210 and an outer shell 220. The outer shell 220 covers the outer side of the rotating cover 210 and is formed with a mounting cavity for mounting the lock catch 10. The lock catch 10 is movably arranged on the mounting cavity up and down. Certainly, the spring is further arranged on the mounting cavity. The upper end of the spring is in contact with the outer shell 220, and the lower end of the spring is in contact with the lock catch 10. When being applied, the lower end of the spring may be provided with a spring fixing rack 30, and the spring fixing rack 30 is connected to the lock catch 10. Thus, assemblies such as lock catch 10 and elastic piece 20 are hidden in the rotating cover 210 and the outer shell 220. When being locked, others cannot make out the skillful structural design from appearance and do not know the opening mode, so that it is extremely excellent in invisibility.

A lower side surface of the cup body 100 is upwards provided with a placing position for storing the unlocking piece 300 in a concave manner. By arranging the placing position of the unlocking piece 300 on the lower side surface of the cup body 100, on the one hand, the storage problem of the unlocking piece 300 is solved, and on the other hand, the unlocking piece 300 further has certain invisibility in storage position, and furthermore, the integral appearance effect is not affected. Similarly, the upper side surface of the cup cover 200 is downwards provided with an unlocking concave position 202 in a concave manner. When the unlocking piece 300 is placed in the unlocking concave position 202, a rotary unlocking function is realized. By designing the unlocking concave position 202, it is easier to position when being unlocked. The unlocking piece 300 is better adsorbed (magnetically adsorbed) relative to the lock catch 10.

The design point of the invention is that a specific locking design of the cup body and the cup cover solves the problem that conventional pressing type and fingerprint unlocking type structures are easily unlocked by others or the unlocking modes are known to the others as the structures are insufficient in invisibility, so that the privacy, the property safety and the life safety of a user are further guaranteed;

Further, the locking structure of the invention is skillful in locking design, firm and reliable to lock, simple in opening mode, low in manufacturing cost and higher in practicality, and has a considerable market prospect.

Apparently, the embodiments of the invention are merely examples made for describing the invention clearly and are not to limit the embodiments of the invention. Apparent changes or variations explicated from essence and spirit of the invention still fall into the scope of protection of the invention.

What is claimed is:

1. A locking structure of a cup, comprises a cup body and a cup cover, wherein the cup body is provided with a first buckle, and the cup cover is provided with a second buckle adaptive to the first buckle; the locking structure further comprises a lock catch which is movably arranged on the cup cover up and down; wherein the lock catch is provided with a bolt, and correspondingly, the cup body is provided with a bolt hole adaptive to the bolt; and the cup cover rotates on the cup body, so that the first buckle and the second buckle are matched when aligned, the bolt falls into the bolt hole, thereby realizing rotary locking.

2. The locking structure of a cup according to claim 1, further comprising an unlocking piece, wherein the unlocking piece and the lock catch are arranged in a mutual adsorbing manner; and when the unlocking piece is placed on an upper side of the lock catch, the unlocking piece sucks the lock catch upwards, so that the bolt is separated from the bolt hole, thereby realizing rotary unlocking.

3. The locking structure of a cup according to claim 2, wherein the unlocking piece and the lock catch magnets with opposite magnetisms;

or one of the unlocking piece and the lock catch is a magnet while the other is a magnetic metal piece.

4. The locking structure of a cup according to claim 1, wherein the upper side of the lock catch is provided with an elastic piece, so that the lock catch has an action force of moving downwards.

5. The locking structure of a cup according to claim 1, wherein the first buckle is an "L"-shaped slot provided with a vertical clamp-in portion and a clamping portion connected to a lower end of the clamp-in portion; the clamp-in portion is provided with an upward through opening; and the second buckle is a clamping protrusion, and when the second buckle is locked, the clamping protrusion enters the lower end of the clamp-in portion from the opening of the clamp-in portion, and the clamping protrusion enters and is limited by the clamping portion of the slot as the cup cover rotates.

6. The locking structure of a cup according to claim 1, wherein the lock catch comprises a lock catch base, the bolt is formed by extending along an outer edge of the lock catch base, and several bolts are formed at an interval in the outer edge of the lock catch base, and correspondingly, the cup body is further provided with corresponding several bolt holes.

7. The locking structure of a cup according to claim 1, wherein the cup cover comprises a rotating cover and an outer shell, the outer shell covering an outer side of the rotating cover and being formed with a mounting cavity for mounting the lock catch and the lock catch being movably arranged on the mounting cavity up and down.

8. The locking structure of a cup according to claim 2, wherein a lower side surface of the cup body is upwards provided with a placing position for storing the unlocking piece in a concave manner.

9. The locking structure of a cup according to claim 4, wherein the elastic piece is a spring.

* * * * *